US005915984A

United States Patent [19]

Rupert et al.

[11] Patent Number: 5,915,984

[45] Date of Patent: Jun. 29, 1999

[54] MODULAR ELECTRICAL OUTLET AND CONNECTOR ASSEMBLY

[75] Inventors: Brian K. Rupert, Fort Wayne; Phillip A. McCoy, Albion, both of Ind.

[73] Assignee: Dekko Engineering, Inc., Butler, Ind.

[21] Appl. No.: 08/703,391

[22] Filed: Aug. 26, 1996

[51] Int. Cl.[6] ..... H01R 4/60

[52] U.S. Cl. ..... 439/215; 439/654; 439/171

[58] Field of Search ..... 439/215, 650, 439/654, 170, 171, 216

[56] References Cited

U.S. PATENT DOCUMENTS

| | | | |
|---|---|---|---|
| 3,085,221 | 4/1963 | Kelly | 339/186 |
| 3,399,374 | 8/1968 | Pauza et al. | 339/91 |
| 4,313,646 | 2/1982 | Millhimes et al. | 339/156 R |
| 4,740,167 | 4/1988 | Millhimes et al. | 439/654 |
| 4,758,185 | 7/1988 | Reuss | 439/701 |
| 5,052,951 | 10/1991 | Johnson | 439/723 |
| 5,073,120 | 12/1991 | Lincoln et al. | 439/215 |
| 5,242,319 | 9/1993 | Ju | 439/752 |
| 5,466,171 | 11/1995 | Bixler et al. | 439/378 |
| 5,503,565 | 4/1996 | McCoy | 439/171 |
| 5,584,714 | 12/1996 | Karst et al. | 439/215 |

*Primary Examiner*—Gary Paumen
*Assistant Examiner*—Katrina Davis
*Attorney, Agent, or Firm*—Taylor & Associates, P.C.

[57] ABSTRACT

The invention is directed to a modular electrical outlet including a housing; a pair of plug-in connectors carried by and disposed at opposing ends of the housing; and a conductor disposed within the housing. Each of the connectors includes a plurality of terminal receiving openings. The conductor includes a pair of blade receiving sockets, with a longitudinal axis extending between the blade receiving sockets. The conductor includes a pair of terminals at opposing ends thereof, with each terminal being offset from the longitudinal axis. The conductor may be selectively positioned in the housing at one of two reversible positions. To wit, the conductor may be selectively disposed within the housing in a first position such that each terminal is received within an associated terminal receiving opening of a respective connector, and a second position such that each terminal is received within an associated terminal receiving opening of the other respective connector.

5 Claims, 5 Drawing Sheets

MODULAR ELECTRICAL OUTLET AND CONNECTOR ASSEMBLY

BACKGROUND OF THE INVENTION

1. Field of the Invention

The present invention relates to a modular electrical power distribution system, and, more particularly, to such a system including a modular electrical outlet and connector assembly.

2. Description of the Related Art

A modular power distribution system may include a wiring harness or channel which is connected with a modular electrical device, such as an electrical outlet. The wiring harness or channel typically includes a plurality of wires which are associated with line, neutral and ground conductors of the system. For example, in one known ten wire power distribution system, six wires are associated with line conductors, two wires are associated with neutral conductors, and two wires are associated with ground conductors. Each of the ten conductors is electrically connected with an associated terminal in a plug-in type connector. The modular electrical outlet includes a plug-in type connector which is mated with the connector on the wiring harness such that conductors disposed within the electrical outlet are connected with selected ones of the terminals in the plug-in connector of the wiring harness. For a conventional, single phase, 115 volt AC electrical outlet, three conductors are disposed within the electrical outlet which electrically interconnect the pair of plug-in connectors at each end of the outlet with associated blade receiving sockets disposed below blade receiving openings formed in the faceplate of the outlet. A line conductor extends to a selected one of the six associated terminals in the plug-in connector at each end of the electrical outlet.

During the manufacture of a modular electrical outlet as described above, the outlet is wired according to one of a plurality of wiring configurations. A number of electrical outlets with different wiring configurations are provided to the user who then selects the appropriate wired outlet for a particular application. The line, neutral and ground conductors within the electrical outlet are typically not in the form of a wire, but rather in the form of a relatively rigid conductor which is formed to a predetermined shape and placed within the electrical outlet. Accordingly, with a conventional modular electrical outlet having a line conductor which is selectively connected to one of six different terminals in the mating wiring harness plug-in connector, it is necessary to provide six differently formed line conductors for interconnection with the respective connector terminals. An assembly person selects one of the six different line conductors and places the same within the housing of the electrical outlet. Similarly, one of two differently formed neutral conductors, and one of two differently formed ground conductors are also placed within the housing of the electrical outlet.

A problem with conventional modular electrical outlets is that a relatively large number of conductors must be formed and maintained in stock for an assembly person to choose from during the assembly of the outlet. For example, with a modular electrical outlet having a line conductor which may be selectively associated with one of six different conductors in the wiring harness, it is necessary that six different line conductors be formed for a user to choose from during the assembly of the modular electrical outlet.

A connector assembly which is used in a power distribution system as described above may include a plurality of conductors therein which define the terminals extending into the terminal receiving openings of a connector. The connector assembly is typically connected to the plurality of wires within the wiring harness or channel, such as the ten wires described above. To connect the conductors within the connector assembly to the wires, each conductor may include a crimped termination which is crimped to a respective wire. The conductors are typically over molded with a plastic injection molding process, and the crimped terminations are either imbedded within the connector assembly or extend from the connector assembly.

A problem with a conventional connector assembly as described above is that with a power distribution system having a relatively large number of wires, e.g., a ten wire system, the size of the connector assembly becomes relatively large in order to accommodate physical tolerances between the crimped terminations. That is, with a conventional connector assembly, the crimped terminations are aligned relative to each other such that a substantially linear row of crimped terminations results. Since each crimped termination may be larger in diameter than the wire about which it is crimped, the side-to-side spacing between conductors is limited by the size of the crimped terminations with appropriate spacing therebetween to prevent electrical shorting.

What is needed in the art is a modular electrical outlet which may be relatively easily assembled, and requires less inventory to be maintained in stock.

What is further needed in the art is an electrical connector assembly which includes a relatively large number of conductors without resulting in an excessively large connector assembly.

SUMMARY OF THE INVENTION

The present invention provides a modular electrical outlet having a conductor which is associated with a pair of blade receiving openings in a housing. The conductor includes a pair of terminals at opposing ends thereof which are disposed offset relative to the blade receiving openings such that the conductor may be reversibly positioned within the housing at one of two orientations.

The invention comprises, in one form thereof, a modular electrical outlet including a housing; a pair of plug-in connectors carried by and disposed at opposing ends of the housing; and a conductor disposed within the housing. Each of the connectors includes a plurality of terminal receiving openings. The conductor includes a pair of blade receiving sockets, with a longitudinal axis extending between the blade receiving sockets. The conductor includes a pair of terminals at opposing ends thereof, with each terminal being offset from the longitudinal axis. The conductor may be selectively positioned in the housing at one of two reversible positions. To wit, the conductor may be selectively disposed within the housing in a first position such that each terminal is received within an associated terminal receiving opening of a respective connector, and a second position such that each terminal is received within an associated terminal receiving opening of the other respective connector.

The invention comprises, in another form thereof, an electrical connector assembly attached with a plurality of electrical wires. The connector assembly includes a housing; at least two plug-in connectors which are integral with or carried by the housing; and a plurality of conductors disposed within the housing in substantially parallel relationship to each other. Each connector includes a plurality of terminal receiving openings. Each conductor has at least two terminals, with each terminal being received within an associated terminal receiving opening of a respective one of the at least two plug-in connectors. Each conductor further has a crimped termination attachable with one of the wires. Each crimped termination is disposed in a staggered relationship relative to a crimped termination of an adjacent conductor whereby the conductors may be placed closer together without interference between the crimped terminations.

An advantage of the present invention is that the number of conductors which are required to configure the modular electrical outlet according to a plurality of different wiring configurations is substantially reduced.

Another advantage is that by reducing the number of conductors necessary to effect a plurality of wiring schematics within the electrical outlet, manufacturing and inventory costs are reduced.

Yet another advantage is that the width of a connector may be reduced by staggering the crimped terminations.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplification are not to be construed as limiting the scope of the invention in any manner.

DETAILED DESCRIPTION OF THE INVENTION

Figure 1:
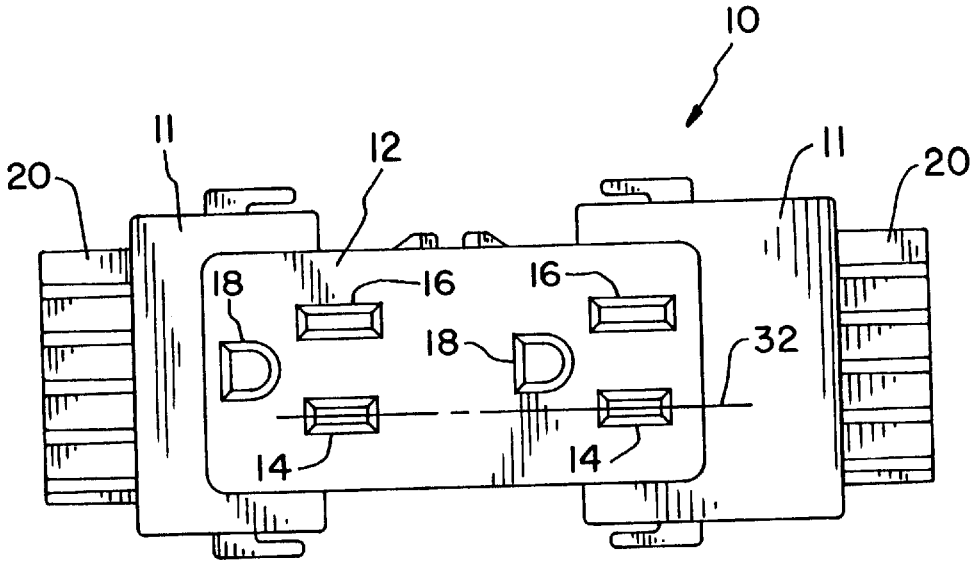
FIG. 1 is a plan view of an embodiment of a modular electrical outlet of the present invention.
Figure 2:
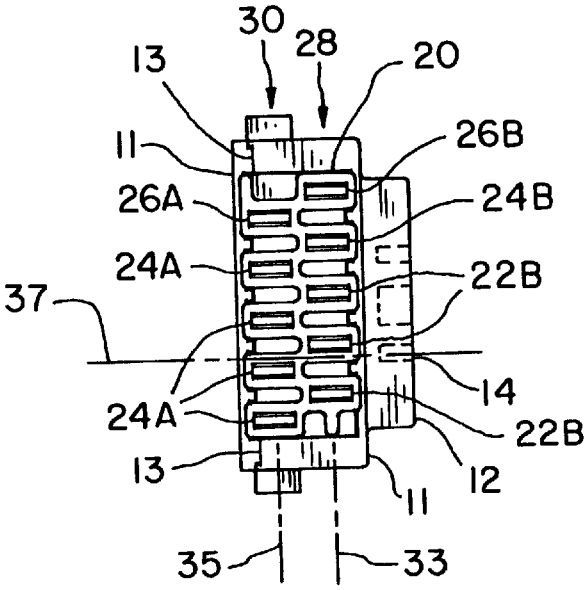
FIG. 2 is an end view of the modular electrical outlet shown in FIG. 1.

Referring now to the drawings, and particularly to FIGS. 1 and 2, there is shown an embodiment of a modular electrical outlet 10 of the present invention which may be connected to a wiring harness or channel (not shown) of an electrical power distribution system. Modular electrical outlet 10 includes a housing 11 having a faceplate 12. Faceplate 12 includes a first pair of blade receiving openings 14, a second pair of blade receiving openings 16, and a third pair of blade receiving openings 18. Blade receiving openings 14, 16 and 18 are configured for receiving the blades of a male electrical plug (not shown) therein. Blade receiving openings 14 are associated with a line conductor; blade receiving openings 16 are associated with a neutral conductor; and blade receiving openings 18 are associated with a ground conductor. Blade receiving openings 14 define a longitudinal axis 32 extending therebetween.

A pair of plug-in connectors 20 are disposed at opposing ends of housing 11. In the particular embodiment shown, connectors 20 are formed separately from housing 11, and are connected to and carried by housing 11. Housing 11 includes a split line 13 (FIG. 2) allowing assembly and disassembly of modular electrical outlet 10. Each connector 20 includes a plurality of terminal receiving openings 22A, 22B, 24A, 24B, 26A and 26B. Terminal receiving openings 22B, 24B and 26B define a first row of terminal receiving openings 28 and a first latitudinal axis 33; and terminal receiving openings 22A, 24A and 26A define a second row of terminal openings 30 and a second latitudinal axis 35. The first row of terminal receiving openings 28 is disposed adjacent to faceplate 12, as indicated in FIG. 2. A third axis 37 is perpendicular to longitudinal axis 32 and to each latitudinal axis 33 and 35.

As is apparent from FIG. 2, each connector 20 includes ten terminal receiving openings 22A, 22B, 24A, 24B, 26A and 26B therein. Terminal receiving openings 22A and 22B are associated with a line conductor within electrical outlet 10; terminal receiving openings 24A and 24B are associated with a ground conductor within electrical outlet 10; and terminal receiving openings 26A and 26B are associated with a neutral conductor within electrical outlet 10. Blade receiving openings 14 of faceplate 12 (FIGS. 1 and 2) and terminal receiving openings 22A, 22B of connector 20 are each associated with a line conductor disposed within electrical outlet 10, as will be described below. Terminal receiving openings 22A, 22B are substantially symmetrically positioned on opposite sides of longitudinal axis 32 extending through blade receiving openings 14. For example, referring to FIG. 2, the top terminal receiving opening 22B in first row 28 is disposed the same transverse distance away from blade receiving opening 14 as the bottom terminal receiving opening 22A in second row 30.

Referring now to FIGS. 3A, 3B, 4A, 4B, 5A and 5B, it may be seen that each modular electrical outlet 10 includes three conductors disposed therein. The three conductors correspond to a line conductor, neutral conductor and ground conductor. The neutral conductor includes a pair of terminals at opposing ends thereof which are formed so as to be associated with one of terminal receiving openings 26A or 26B shown in FIG. 2. Similarly, the ground conductor includes a pair of terminals at opposing ends thereof which are formed so as to be associated with one of terminal receiving openings 24A or 24B shown in FIG. 2.

Figure 3A:
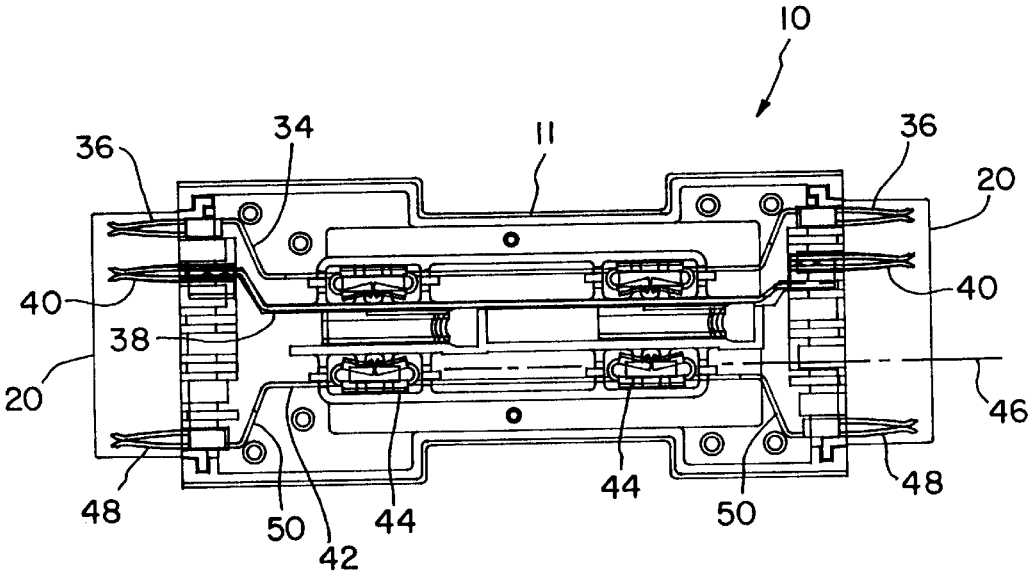
FIGS. 3A and 3B illustrate the positioning of the line, neutral and ground conductors within the modular electrical outlet shown in FIGS. 1 and 2, with a first line conductor being shown in selected reversible positions, respectively.
Figure 3B:
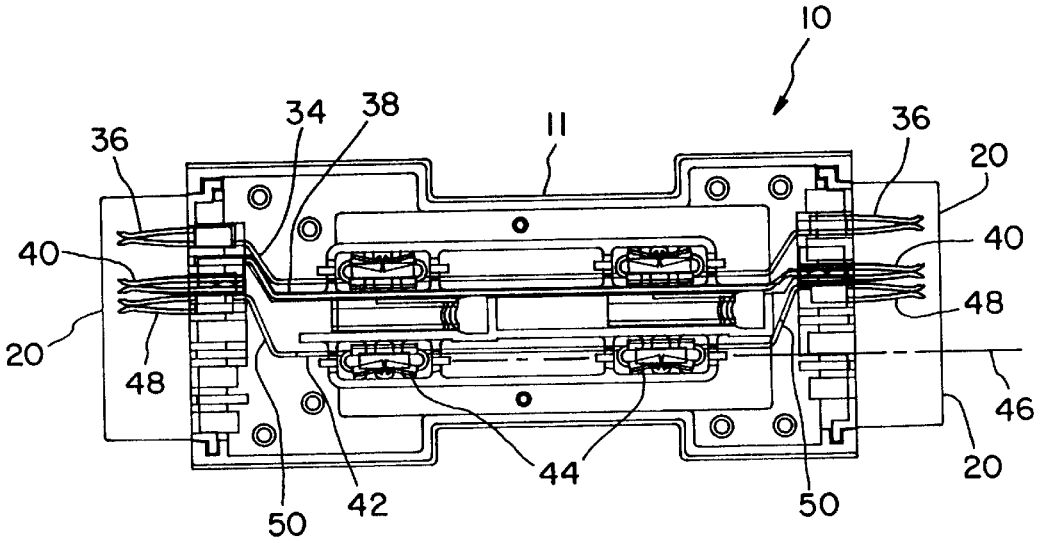

Referring specifically to FIGS. 3A and 3B, two different possible wiring configurations are shown for electrical outlet 10. In the different configurations shown in FIGS. 3A and 3B, two different neutral conductors 34 are respectively shown and utilized. Neutral conductor 34 is formed such that terminals 36 at opposing ends thereof are associated with and disposed within a selected one of terminal receiving openings 26A or 26B (FIG. 2). Similarly, the different wiring configurations shown in electrical outlets 10 of FIGS. 3A and 3B include two differently formed ground conductors 38 having opposing terminals 40 which are selectively associated with and disposed within terminal receiving openings 24A or 24B shown in FIG. 2.

A first line conductor 42 is also disposed within housing 11 and includes a pair of blade receiving sockets 44 which are formed integrally therewith. Blade receiving sockets 44 are respectively associated with blade receiving openings 14 formed in faceplate 12 (FIGS. 1 and 2). Line conductor 42 includes a longitudinal axis 46 extending through blade receiving sockets 44. Longitudinal axis 46 of line conductor 42 generally lies along the same plane as longitudinal axis 32 extending through blade receiving openings 14 (i.e., viewed perpendicular to the drawings of FIGS. 3A and 3B).

Line conductor 42 includes a pair of terminals 48 at opposing ends thereof. Each terminal 48 is offset from longitudinal axis 46 a transverse distance associated with the length of a pair of respective legs 50. Each of terminals 48 are disposed a substantially equal distance in a direction perpendicular to longitudinal axis 46. A terminal 48 disposed at one end of line conductor 42 is positioned within a terminal receiving opening of one of rows 28 or 30, and a terminal 48 disposed at the opposing end of line conductor 42 is disposed in a terminal receiving opening of the other of rows 28 or 30.

Line conductor 42 is formed such that it may be placed within electrical outlet 10 in one of two reversible positions shown in FIGS. 3A and 3B. Thus, as opposed to using two differently formed line conductors to effect the wiring configurations shown in FIGS. 3A and 3B, the present invention essentially reduces the number of required line conductors in half by utilizing the same line conductor 42 for each of the wiring configurations shown in FIGS. 3A and 3B. In particular, terminals 48 are offset from longitudinal axis 46 such that line conductor 42 may be selectively disposed within housing 11 in a first position (shown in FIG. 3A) such that each terminal 48 is received within an associated terminal receiving opening 22A or 22B of a respective connector 20, and a second position (shown in FIG. 3B) such that each terminal 48 is received within an associated terminal receiving opening 22A or 22B of the other respective connector 20.

Figure 4A:
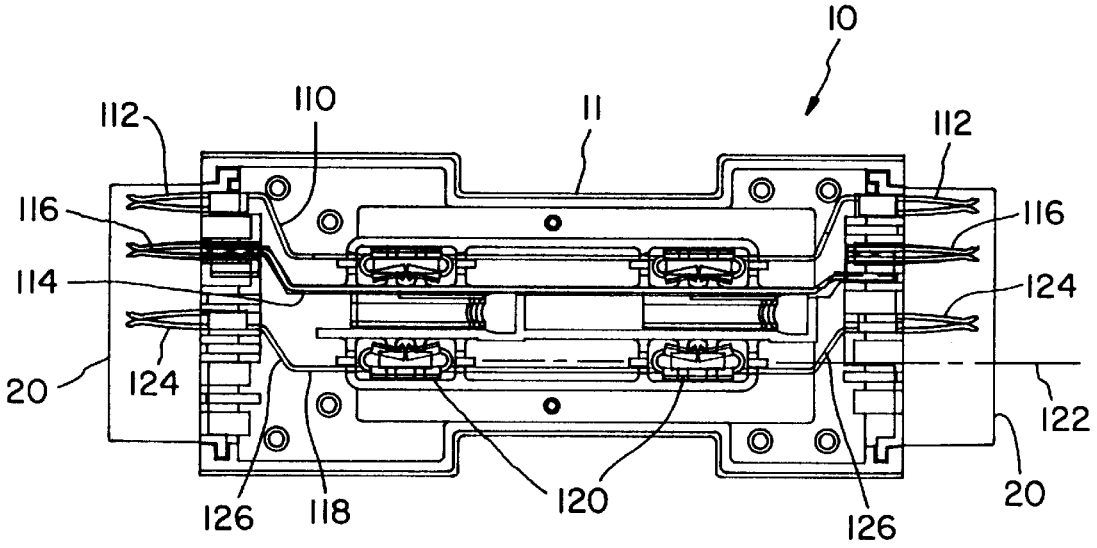
FIGS. 4A and 4B illustrate the positioning of the line, neutral and ground conductors within the modular electrical outlet shown in FIGS. 1 and 2, with a second line conductor being shown in selected reversible positions, respectively.
Figure 4B:
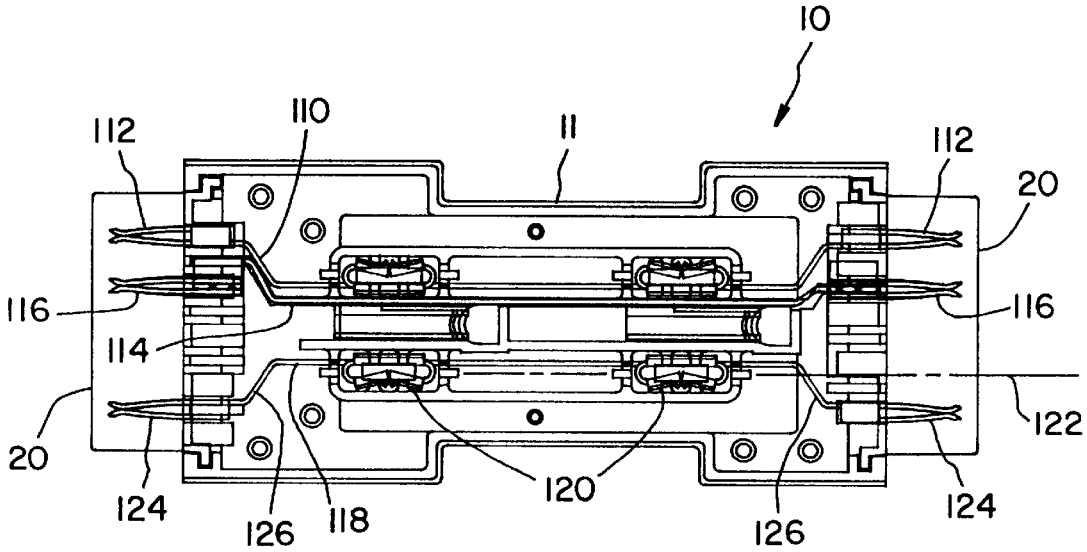

Referring now to FIGS. 4A and 4B, two additional possible wiring configurations are shown for electrical outlet 10. In the different configurations shown in FIGS. 4A and 4B, two different neutral conductors 110 are shown and utilized. Each neutral conductor 110 is formed such that terminals 112 at opposing ends thereof are associated with and disposed within a selected one of terminal receiving openings 26A or 26B (FIG. 2). Similarly, the different wiring configurations shown in electrical outlets 10 of FIGS. 4A and 4B include differently formed ground conductors 114 having opposing terminals 116 which are selectively associated with and disposed within terminal receiving openings 24A or 24B shown in FIG. 2.

A second line conductor 118 is also disposed within housing 11 and includes a pair of blade receiving sockets 120 which are formed integrally therewith. Blade receiving sockets 120 are respectively associated with blade receiving openings 14 formed in faceplate 12 (FIGS. 1 and 2). Line conductor 118 includes a longitudinal axis 122 extending through blade receiving sockets 120. Longitudinal axis 122 of line conductor 118 generally lies along the same plane as longitudinal axis 32 extending through blade receiving openings 14 (i.e., viewed parallel to the drawings of FIGS. 4A and 4B).

Line conductor 118 includes a pair of terminals 124 at opposing ends thereof. Each terminal 124 is offset from longitudinal axis 122 a transverse distance associated with the length of a pair of respective legs 126. Legs 126 are shorter in length than legs 50 shown in FIGS. 3A and 3B. Each of terminals 124 are disposed a substantially equal distance in a direction perpendicular to longitudinal axis 122. A terminal 124 disposed at one end of line conductor 118 is positioned within a terminal receiving opening of one of rows 28 or 30, and a terminal 124 disposed at the opposing end of line conductor 118 is disposed in a terminal receiving opening of the other of rows 28 or 30.

Line conductor 118 is formed such that it may be placed within electrical outlet 10 in one of two reversible positions shown in FIGS. 4A and 4B. Terminals 124 are offset from longitudinal axis 122 such that line conductor 118 may be selectively disposed within housing 11 in a first position (shown in FIG. 4A) such that each terminal 124 is received within an associated terminal receiving opening 22A or 22B of a respective connector 20, and a second position (shown in FIG. 4B) such that each terminal 124 is received within an associated terminal receiving opening 22A or 22B of the other respective connector 20.

Figure 5A:
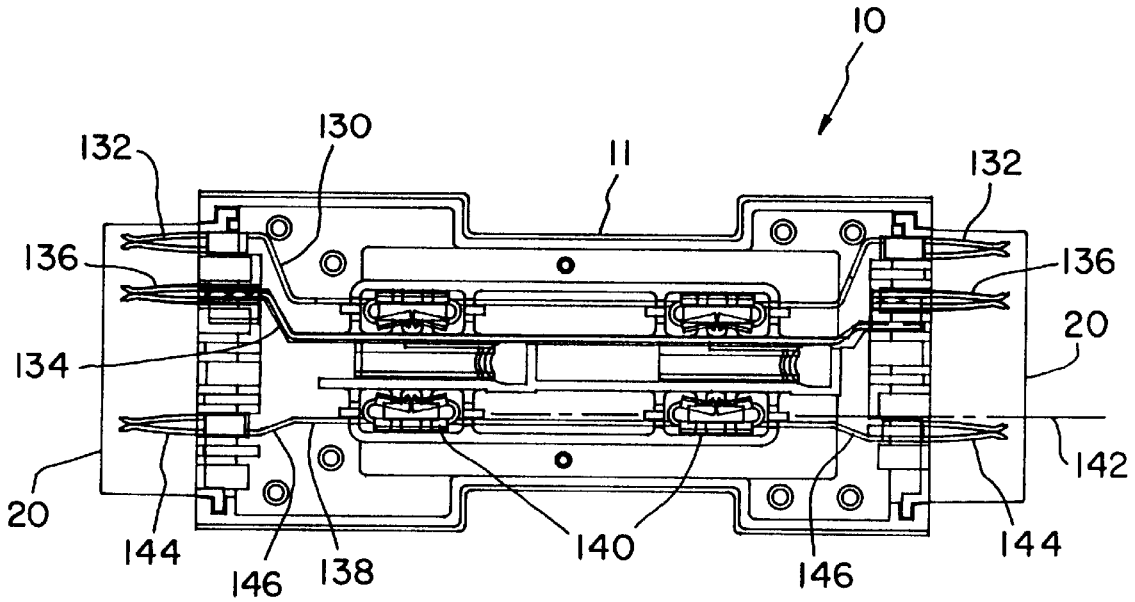
FIGS. 5A and 5B illustrate the positioning of the line, neutral and ground conductors within the modular electrical outlet shown in FIGS. 1 and 2, with a third line conductor being shown in selected reversible positions, respectively.
Figure 5B:
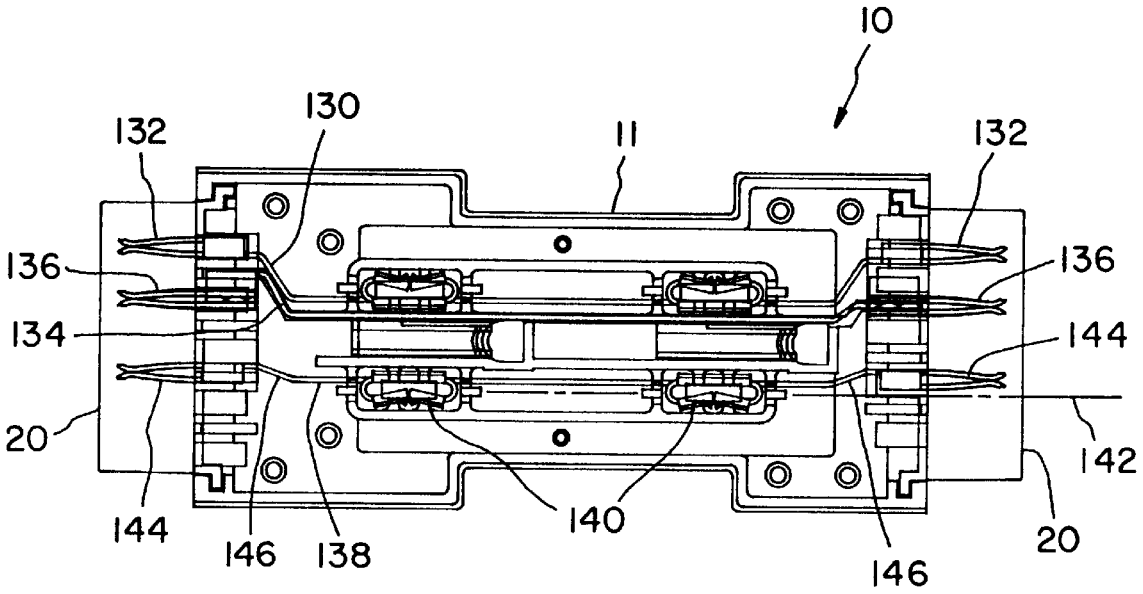

Referring now to FIGS. 5A and 5B, two further possible wiring configurations are shown for electrical outlet 10. In the different configurations shown in FIGS. 5A and 5B, two different neutral conductors 130 are shown and utilized. Each neutral conductor 130 is formed such that terminals 132 at opposing ends thereof are associated with and disposed within a selected one of terminal receiving openings 26A or 26B (FIG. 2). Similarly, the different wiring configurations shown in electrical outlets 10 of FIGS. 5A and 5B include differently formed ground conductors 134 having opposing terminals 136 which are selectively associated with and disposed within terminal receiving openings 25A or 25B shown in FIG. 2.

A third line conductor 138 is also disposed within housing 11 and includes a pair of blade receiving sockets 140 which are formed integrally therewith. Blade receiving sockets 140 are respectively associated with blade receiving openings 14 formed in faceplate 12 (FIGS. 1 and 2). Line conductor 138 includes a longitudinal axis 142 extending through blade receiving sockets 140. Longitudinal axis 142 of line conductor 138 generally lies along the same plane as longitudinal axis 32 extending through blade receiving openings 14 (i.e., viewed parallel to the drawings of FIGS. 5A and 5B).

Line conductor 138 includes a pair of terminals 144 at opposing ends thereof. Each terminal 144 is offset from longitudinal axis 142 a transverse distance associated with the length of a pair of respective legs 146. Legs 146 are shorter in length than legs 126 shown in FIGS. 4A and 4B. Each of terminals 144 are disposed a substantially equal distance in a direction perpendicular to longitudinal axis 142. A terminal 144 disposed at one end of line conductor 138 is positioned within a terminal receiving opening of one of rows 28 or 30, and a terminal 144 disposed at the opposing end of line conductor 138 is disposed in a terminal receiving opening of the other of rows 28 or 30.

Line conductor 138 is formed such that it may be placed within electrical outlet 10 in one of two reversible positions shown in FIGS. 5A and 5B. Terminals 144 are offset from longitudinal axis 142 such that line conductor 138 may be selectively disposed within housing 11 in a first position (shown in FIG. 5A) such that each terminal 144 is received within an associated terminal receiving opening 22A or 22B of a respective connector 20, and a second position (shown in FIG. 5B) such that each terminal 144 is received within an associated terminal receiving opening 22A or 22B of the other respective connector 20.

Figure 6:
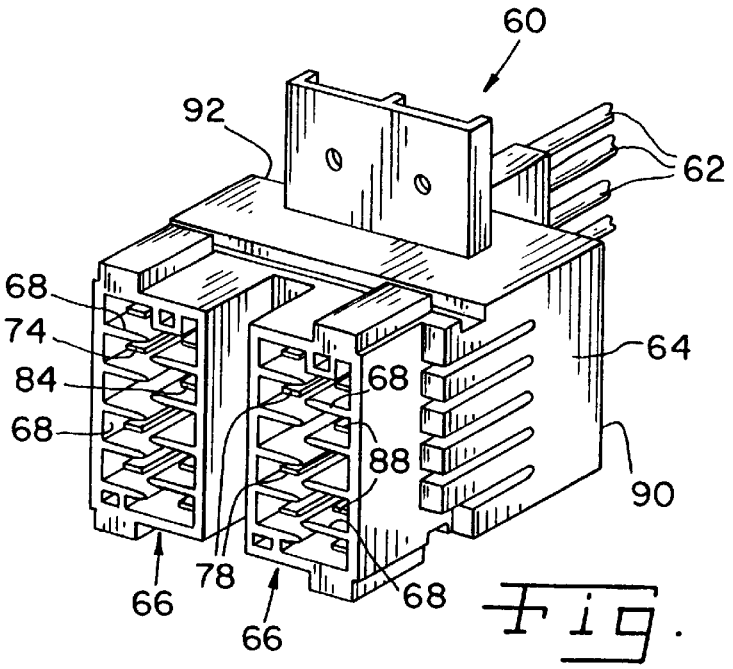
FIG. 6 is a perspective view of an embodiment of an electrical connector assembly of the present invention.
Figure 7:
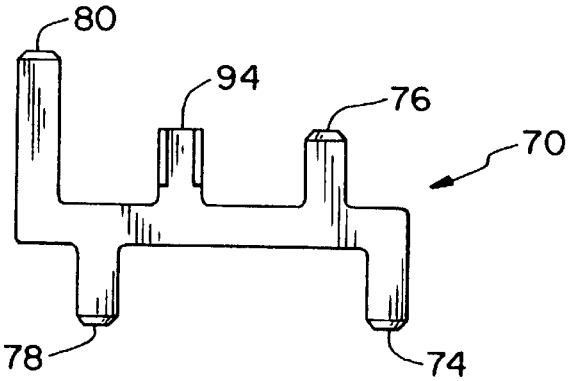
FIG. 7 is a plan view of an embodiment of a multi-terminal conductor disposed within the electrical connector assembly of FIG. 6, with a crimped termination disposed at a first staggered position.
Figure 8:
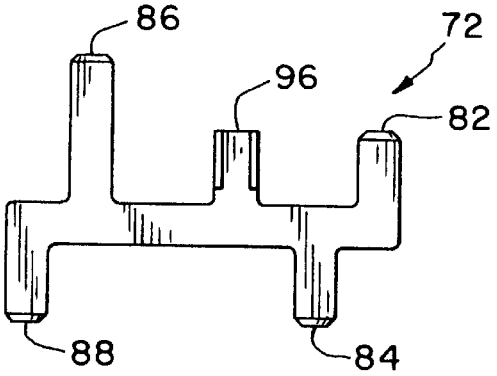
FIG. 8 is a plan view of another embodiment of a multi-terminal conductor disposed within the electrical connector assembly of FIG. 6, with a crimped termination disposed at a second staggered position.

Referring now to FIGS. 6–8, there is shown an embodiment of an electrical connector assembly 60 of the present invention which is attached with a plurality of electrical wires 62. Connector assembly 60 includes a housing 64 and a plurality of plug-in connectors, two of which are shown and referenced 66 in FIG. 6. Connectors 66 are formed integrally with housing 64 in the embodiment shown in FIG. 6, but may also be separately formed and attached to housing 64. Each connector 66 includes a plurality of terminal receiving openings 68 formed therein.

Disposed within housing 64 of connector assembly 60 are a plurality of conductors 70 (FIG. 7) and 72 (FIG. 8). Conductors 70, 72 are disposed in substantially parallel relationship to each other, and include four terminals each. In particular, conductor 70 includes terminals 74, 76, 78 and 80, and conductor 72 includes terminals 82, 84, 86 and 88. Terminals 74 and 78 of conductor 70, and terminals 84 and 88 of conductor 72 are associated with connectors 66 as shown in FIG. 6. Terminal 80 of conductor 70 and terminal 86 of conductor 72 are associated with a connector 90 (FIG. 6) located on the back of connector assembly 64. Similarly, terminal 76 of conductor 70 and terminal 82 of conductor 72 are associated with a connector 92 (FIG. 6) on the back of connector assembly 64.

Conductors 70, 72 each include a crimped termination 94, 96, respectively, which are each attached with an associated one of the electrical wires 62. Each crimped termination 94, 96, is disposed in a staggered relationship relative to a crimped termination of an adjacent conductor, whereby conductors 70, 72 may be placed closer together without interference between crimped terminations 94, 96. More particularly, as will be appreciated, an end portion of a non-conductive coating around a wire 62 is stripped prior to wire 62 being placed within a crimped termination 94, 96. Crimped termination 94, 96 is then crimped around the end of wire 62. Since a minimum distance must be maintained between crimped terminations 94, 96 to prevent electrical arcing or shorting therebetween, the minimum distance between adjacent conductors 70, 72 is generally determined by the diameter of a crimped termination 94, 96 and the required minimum distance between adjacent crimped terminations 94, 96. By staggering crimped terminations 94, 96 as shown in FIGS. 6–8, the distance between parallel conductors 70, 72 may be reduced, which in turn reduces the overall width of connector assembly 60. Thus, the present invention reduces the overall width of connector assembly 60.

Figure 9:
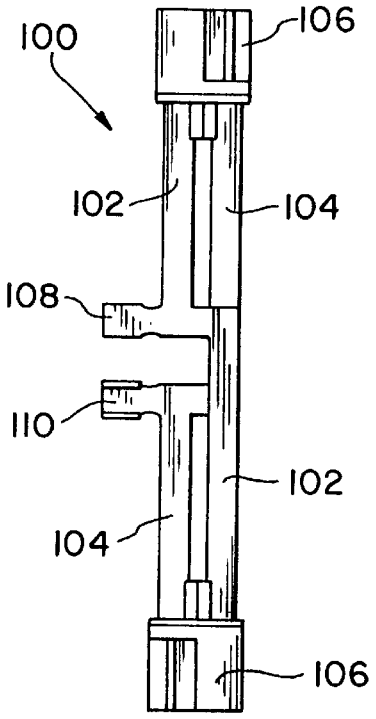
FIG. 9 is a partial, side view of an another embodiment of an electrical connector assembly of the present invention.

Referring now to FIG. 9, there is shown a side view of a portion of an embodiment of a connector assembly 100 of the present invention. Connector assembly 100 includes a plurality of conductors, two of which are shown and are referenced 102, 104 in FIG. 9. Conductors 102, 104 include terminals (not shown) at opposing ends thereof which are received within associated terminal receiving openings of opposing connectors 106. Conductors 102, 104 and connectors 106 are disposed within a housing (not shown). Connectors 106 include two rows of terminal receiving openings, as shown and described above with reference to connectors 66 shown in FIG. 6 and connectors 20 shown in FIGS. 1 and 2. Conductors 102, 104 include a terminal at one end thereof which is disposed in a first row of terminal receiving openings in a connector 106, and a terminal at an opposite end thereof which is disposed in a second row of terminal receiving openings of an opposing connector 106. Each conductor 102, 104 includes a crimped termination 108, 110, respectively, for connection with an associated one of a plurality of electrical wires, such as wires 62 shown in FIG. 6. Each crimped termination 108, 110 is disposed in a staggered relationship relative to a crimped termination of an adjacent conductor, as described with reference to crimped terminations 94, 96 shown in FIGS. 7 and 8.

In the embodiment of modular electrical outlet 10 of the present invention shown in FIGS. 1–5B, line conductors 42, 118 and 138 are selectively associated with six terminals 22A, 22B at either end of outlet 10. Moreover, neutral conductors 34, 110 and 130 are selectively associated with two terminals 26A, 26B at either end of outlet 10. However, it is also to be understood that electrical outlet 10 may be provided with four total line terminals 22A, 22B at each end and four total neutral terminals 26A, 26B at each end. Configured as such, the neutral conductors (not shown) disposed within the electrical outlet may be configured similar to the line conductors such that the blade receiving sockets of the neutral conductors are symmetrically positioned relative to the neutral terminal receiving openings 26A, 26B. Thus, the neutral conductors may also be configured to be symmetrically and reversibly positioned within the modular electrical outlet, thereby reducing the number of required neutral conductors in half.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A modular electrical outlet, comprising:

a housing including a pair of neutral blade receiving openings, each said neutral blade receiving opening being configured for receiving a corresponding neutral blade of a conventional electrical plug, said housing also including a pair of line blade receiving openings, each said line blade receiving opening being configured for receiving a corresponding line blade of a conventional electrical plug;

a pair of plug-in connectors, said connectors being carried by and disposed at opposing ends of said housing, each said connector including at least one row of terminal receiving openings, said terminal receiving openings of each said connector defining a corresponding latitudinal axis extending therethrough, said housing includes a faceplate, and each said connector includes a first row of terminal receiving openings and a second row of terminal receiving openings, said first row of terminal receiving openings disposed adjacent to said faceplate; and a conductor disposed within said housing, said conductor including a pair of blade receiving sockets, each said blade receiving socket being configured for receiving a corresponding blade of a conventional three-prong electrical plug, said conductor having a longitudinal extension defining a longitudinal axis extending therethrough which is substantially perpendicular to each said latitudinal axis, said conductor including a pair of terminals at opposing ends thereof, each said terminal being received within an associated said terminal receiving opening of a respective said connector, each said terminal being offset from said longitudinal axis of said conductor along a respective said latitudinal axis of a respective said connector by a substantially equal amount whereby said conductor may be selectively disposed within said housing in a first position such that said blade receiving sockets are associated with said neutral blade receiving openings of said housing, and a second position such that said blade receiving sockets are associated with said line blade receiving openings of said housing.

2. The modular electrical outlet of claim 1, wherein one of said terminals is received within said first row of one of said connectors and the other of said terminals is received within said second row of the other of said connectors.

3. The modular electrical outlet of claim 1, wherein said conductor comprises a line conductor.

4. A modular electrical outlet, comprising:

a housing;

a pair of plug-in connectors, said connectors being carried by and disposed at opposing ends of said housing, each said connector including two substantially parallel rows of terminal receiving openings, each said row of terminal receiving openings of each said connector defining a corresponding latitudinal axis extending therethrough; and a conductor disposed within said housing, said conductor having a longitudinal extension defining a longitudinal axis which is substantially perpendicular to each said latitudinal axis, each said row of terminal receiving openings of a selected said connector being offset from said longitudinal axis in opposite directions along a third axis, said third axis being substantially perpendicular to each of said longitudinal axis and a respective two said latitudinal axes of a corresponding said connector, said conductor including a pair of terminals at opposing ends thereof, each said terminal being received within an associated said terminal receiving opening of a respective said connector, each said terminal being offset from said longitudinal axis of said conductor along each of a respective said latitudinal axis and a respective said third axis of a respective said connector.

5. The modular electrical outlet of claim 4, wherein each said terminal is offset from said longitudinal axis in opposite directions along a respective said third axis of a respective said connector.

* * * * *